US005511920A

United States Patent [19]

Artrip

[11] Patent Number: 5,511,920

[45] Date of Patent: Apr. 30, 1996

[54] SYSTEM AND METHOD FOR USE WHEN FORMING LIFT-TAB CAN END ASSEMBLIES

[76] Inventor: Donald Artrip, 164 Kaluna Ave., Bluff City, Tenn. 37618

[21] Appl. No.: 136,803

[22] Filed: Oct. 14, 1993

[51] Int. Cl.[6] ..... B21D 43/00; B21D 51/38

[52] U.S. Cl. ..... 413/25; 29/818; 29/525.06; 413/12; 413/14; 413/16

[58] Field of Search ..... 413/14, 16, 25, 413/66, 12; 29/525.1, 525.2, 809, 818

[56] References Cited

U.S. PATENT DOCUMENTS

| | | | |
|---|---|---|---|
| 3,231,968 | 2/1966 | Swanson | 29/809 |
| 4,026,226 | 5/1977 | Hahn | 413/14 |
| 4,568,230 | 2/1986 | Brown | 413/14 |
| 4,723,882 | 2/1988 | Wissman | 413/66 |
| 4,762,579 | 8/1988 | Shimizu | 413/12 |
| 4,932,822 | 6/1990 | De Silva | 413/14 |

*Primary Examiner*—Jack W. Lavinder

[57] ABSTRACT

A system and process for use when forming lift-tab can end assemblies wherein each can end assembly includes a lift tab having a smooth side, an opposite roughened side and a hole extending between the sides and a can end having a protruding shaft integrally formed in one face thereof utilizes a guide system for inverting a strip of metal stock through about 180° as the strip is conveyed between one workstation at which lift tabs are pre-formed therein and another workstation at which the tabs are punched, so as to sever the tabs from, the strip. The punched tabs are thereafter collected in a stacked relationship and directed to a position adjacent still another workstation at which the tabs are attached, by way of the tab holes and the can end shafts, to the can ends. By inverting the strip of metal stock during the assembly-forming process, the tabs are inverted from a smooth-side-down condition to a smooth-side-up condition for attachment to the can end.

8 Claims, 3 Drawing Sheets

SYSTEM AND METHOD FOR USE WHEN FORMING LIFT-TAB CAN END ASSEMBLIES

FIELD AND BACKGROUND OF THE INVENTION

This invention relates to the manufacturing of can end assemblies which each include a can end and a lift tab attached to the can end.

Can top lift tabs are formed from strips of relatively thin metal stock, such as aluminum, by a press which forms the lift tabs by stamping them from a continuous strip. The strip of aluminum stock, both before and after the lift tabs are formed, remains flexible within reasonable limits. Typically, the formed tabs remain loosely attached to the strip at the point where it exits the tab press, where the lift tabs are punched out of the strip and collected in bins. The lift tabs at that time are inverted from their final orientation when attached to the can ends. The can ends are stamped out separately. Lift tabs are collected by hand from the bins, and manually inverted, then carried to another area, where they are fed by hand into chutes, which feed the individual tabs to a conversion press which attaches them to the can ends. The completed can end assemblies are later used to construct completed cans. This procedure of manually inverting the lift tabs and transporting the separated lift tabs is slow and requires an extra step in the manufacturing process. Another process is available wherein the tab press and conversion press are combined in one machine. This is expensive and does not permit the production of the lift tabs in a different location from the conversion process.

It is an object of the present invention to provide a new and improved procedure and system for inverting the lift tabs without the aforedescribed manual step.

Another object of the present invention is to provide such a system wherein lift tabs which are separated from the remainder of the strip are directed into position atop a can end for securement of the lift tab and can end together.

Still another object of the present invention is to provide such a system and procedure which is adaptable in an application in which lift tabs are formed in multiple numbers across the width of the strip of metal stock.

SUMMARY OF THE INVENTION

This invention resides in a process and system for use when forming lift-tab can assemblies wherein each can end assembly includes a lift tab having a smooth side, an opposite roughened side and a hole extending between the sides and a can end having a protruding shaft integrally formed in one face thereof for receipt by, during an assembly-forming process, the hole in the lift tab.

The process includes a step of disposing a tab press in a certain relationship to the conversion press. The strip of metal stock containing the loosely attached lift tabs is directed through one of two evolution: either a half-loop of about 180 vertical degrees, or a half-twist of about 180 degrees. At the end of this evolution, the strip of metal stock is inverted from its orientation when it emerges from the tab press. The strip of metal stock is then conveyed in the appropriate direction from its exit from the tab press to the location of the conversion press, where each tab is separated from the strip of metal stock at the conversion press, where the tab is directly attached to the can end. The strip of metal stock can be run any reasonable distance to the next stage of manufacture. The length of the run will determine whether any guide means are required to support the strip of metal stock. When the strip of metal stock passes over the conversion press, a punch integral to the conversion press removes the loosely attached lift tabs, which are directed by directing means into the correct orientation in the conversion process, where the lift tabs are attached to the can ends to form the lift-tab can end assemblies.

The system of the invention includes means for advancing formed can ends in sequence through a first workstation so that as the can ends are advanced therethrough, the shafts formed therein protrude generally upwardly. Means are also included for conveying a strip of metal stock through a second workstation and then through a third workstation wherein the third workstation is elevated above the first workstation and the second workstation is elevated above the third workstation. First press means are disposed at the second workstation for stamping pre-shaped lift-tab workpieces in the strip so that the workpieces are loosely attached to the remainder of the strip and are oriented smooth-side-down as the workpieces move from the second workstation. The conveying means is adapted to direct the strip stock which has been stamped with the pre-shaped workpieces along a path through which the strip stock is inverted so that as each pre-stamped workpiece moves into the third workstation, the workpiece is positioned smooth-side-up. Second press means are disposed at the third workstation for punching the pre-shaped workpieces from the remainder of the strip as the strip is advanced through the third workstation.

The system also includes means for directing the punched workpieces downwardly from the third workstation to a position disposed to one side of the first workstation and means for moving each punched workpiece from the position disposed to one side of the first workstation to a location at which the workpiece is disposed above a can end positioned in the first workstation. The moving means is coordinated with the conveying means so that as each can end is advanced into position at the first workstation, a corresponding workpiece is moved above the can end so that the hole in the workpiece is positioned in registry with the upwardly-directed shaft formed in the can end. Third press means are disposed adjacent the first workstation for deforming the shaft in a manner which joins the lift tab to the can end.

DETAILED DESCRIPTION OF THE ILLUSTRATED EMBODIMENTS

Many variations and modifications of the embodiments of the invention will be apparent to those skilled in the art without departing from the scope of the invention, which is defined in the claims appended hereto.

Figure 1:
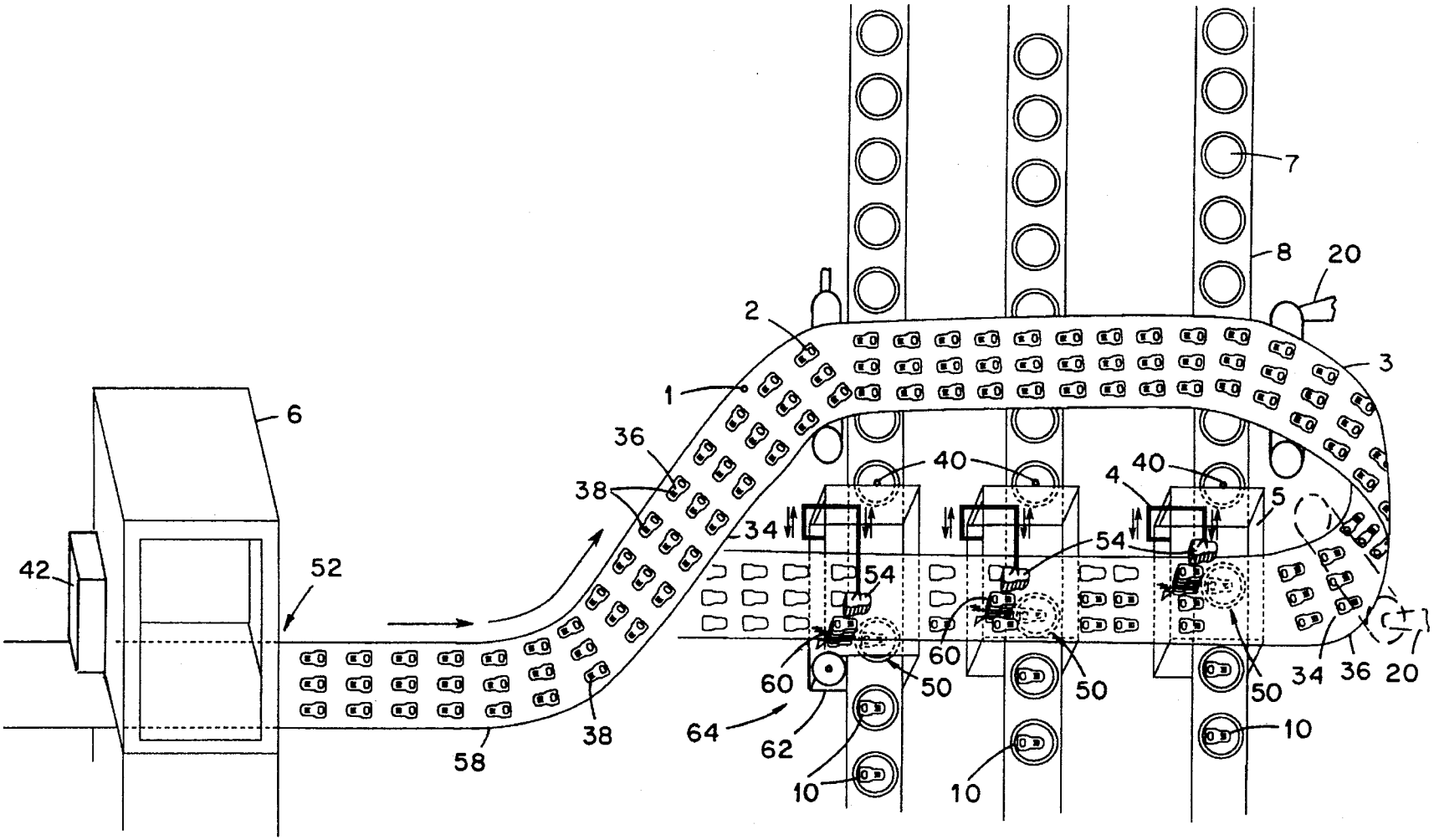
FIG. 1 is a schamatic representation of a preferred embodiment of the invention showing a strip of aluminum stock, with lift tabs loosely attached, passing through the half-loop and moving directly to a multiplicity of conversion presses with integral punch means whereby the loosely attached lift tab is separated from the strip of aluminum stock and attached to the can top.

With reference to FIG. 1, there is shown an environment within which an embodiment, generally indicated 30, of the present invention is utilized. The embodiment 30 is used for forming lift-tab can end assemblies 10 at a first workstation 50 wherein each can end assembly 30 includes a lift tab 2 having a smooth side 34, an opposite roughened side 36 and a hole 38 extending between the sides 34, 36 and a can end 7. At a processing stage which immediately precedes the station 50 at which the lift tab 2 is attached to the can end 7, an upwardly-protruding shaft 40 is integrally formed in one face of the can end 7. During the subsequent assembly-forming process, the hole 38 in the lift tab 2 is positioned in registry with the shaft 40 as will be apparent herein.

With reference still to FIG. 1, a strip of metal, e.g. aluminum, stock 1 with lift tabs 2 loosely attached to the remainder of the strip, is shown passing through the half-loop 3 and moving directly to a punch 4 which is disposed over conversion press 5 which receives the correctly-oriented, i.e., smooth-side-up, lift tabs 2. The strip of aluminum stock 1 is shown passing through a tab press 6 (at a second workstation 52) at which pre-shaped lift tab workpieces 2 are stamped in the strip 1 so that the workpieces are loosely attached to the remainder of the strip 1 and are oriented smooth-side-down as the tabs 2 exit the press 6. Tab press 6 is a standard die cutting press such as, for example, a Minister P2-45, produced by the Minister Machine Company.

The strip of aluminum stock 1 is propelled and controlled by a conveying device 58 such as, for example, a Ferguson Camtrol control box 42. The control box 42 modulates the speed at which the strip 1 is propelled through the entire process. After leaving the tab press 6, the strip 1 is guided through about a 180° vertical turn or half-loop 3 so that upon inversion of the strip 1, the tabs 2 are oriented generally smooth-side-up. This inversion step can be effected by guides adapted for the purpose and which can be of many variations, such as rollers 20. After passing through the half-loop 3, the strip 1 moves in the opposite direction below the level of the tab press 6.

The strip 1 is then advanced to a third workstation 54 at which a punch 4 punches the pre-shaped tabs from the remainder of the strip 1. The punched tabs 2 are collected in a stacked relationship with a chute 60 (depicted in dotted lines) through which each tab 2 is gravitationally directed downwardly toward the base of the chute 60. When positioned at the base of the chute 60, each tab 2 is disposed to one side of the first workstation 50. Although there are shown three first workstations 50 in the FIG. 1 system 30, it will be understood that each of the three workstations 50 provide a station to which a corresponding strip 8 of can ends 7 is advanced for being worked upon with tabs 2 supplied from a corresponding row of tabs 2 formed in the strip 1.

Moving means 64 provided, for example, by a motor-propelled roller 62, is disposed underneath the lowermost tab 2 for moving the tab 2 from the position at the base of the chute 60 to a position, shown in phantom in FIG. 1, at which the tab 2 is disposed above a can end 7 positioned at the first workstation 50. The moving means 64 is coordinated with the conveying means 58 so that as each can end 7 is advanced into position at the first workstation 50, a corresponding tab 2 is moved into a position above the can end 7 so that the hole 38 in the tab 2 is positioned in registry with the upwardly-directed shaft 40 formed in the can end 7. The conversion press 5 subsequently deforms the shaft 40 about the hole 38 so that the deformed shaft 40 secures the tab 2 to the can end 7.

Figure 2:
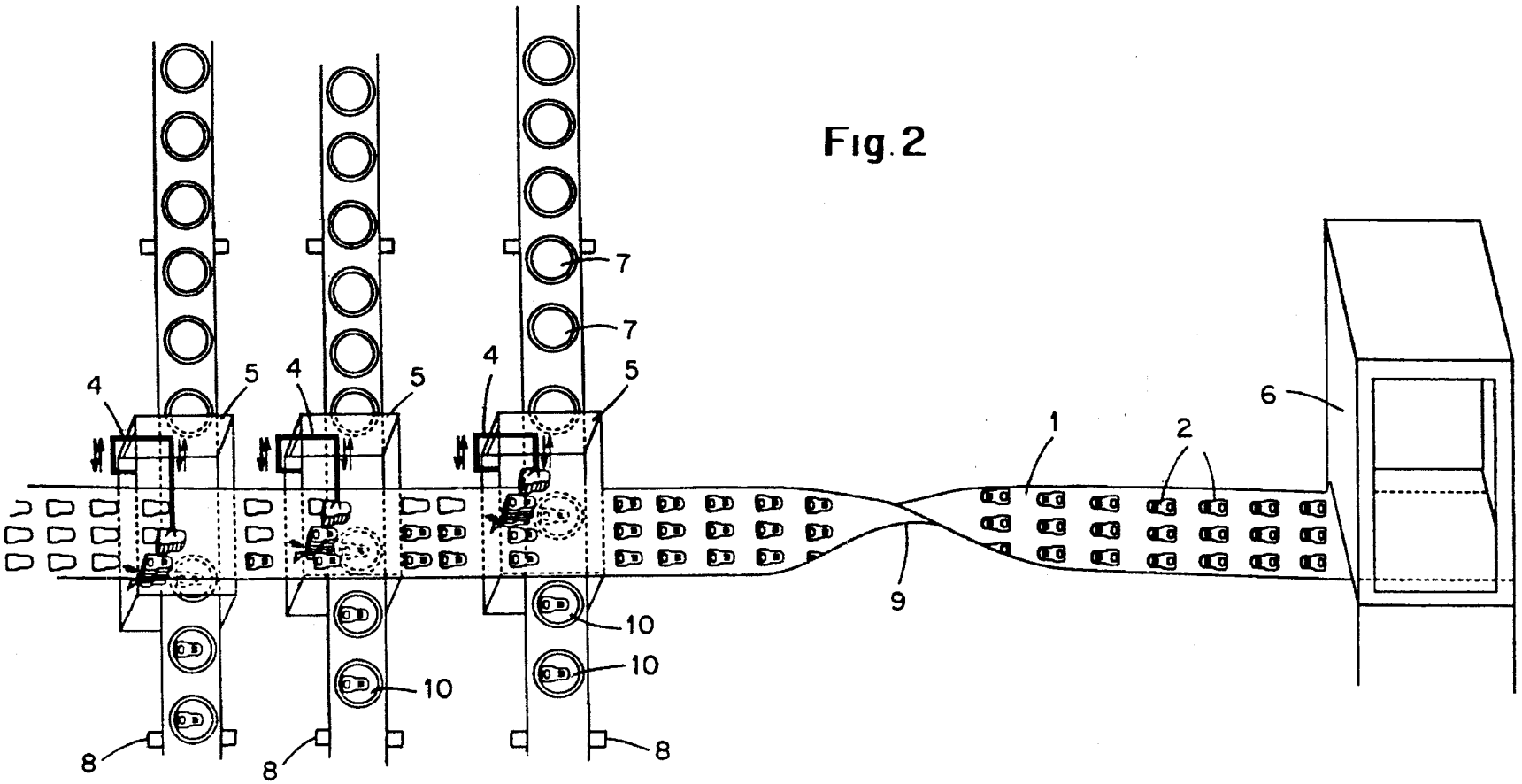
FIG. 2 is a schematic representation of a preferred embodiment of the invention showing a strip of aluminum stock with multiple lift tabs loosely attached, passing through a half-twist, which inverts the strip of aluminum stock with lift tabs loosely attached, and then passes into the multiplicity of conversion presses with integral punches described in FIG. 1.

With reference to FIG. 2, there is shown another embodiment of the invention wherein a strip of aluminum stock 1 having multiple lift tabs 2 is disposed across the width of the strip 1. The strip 1 is moved from the tab press 6 through half-twist 9 by one of the various possible guides associated with this embodiment. After passing through half-twist 9, strip 1 is conveyed across one or more conversion presses 5, with punches 4, which in turn is disposed to remove lift tabs 2 from strip 1 in the correct orientation, i.e. smooth-side-up, to be attached to can tops 7. These can tops 7 are conveyed into conversion presses 5 by conveyor means at which the completed can top assemblies 10 are formed.

Figure 3:
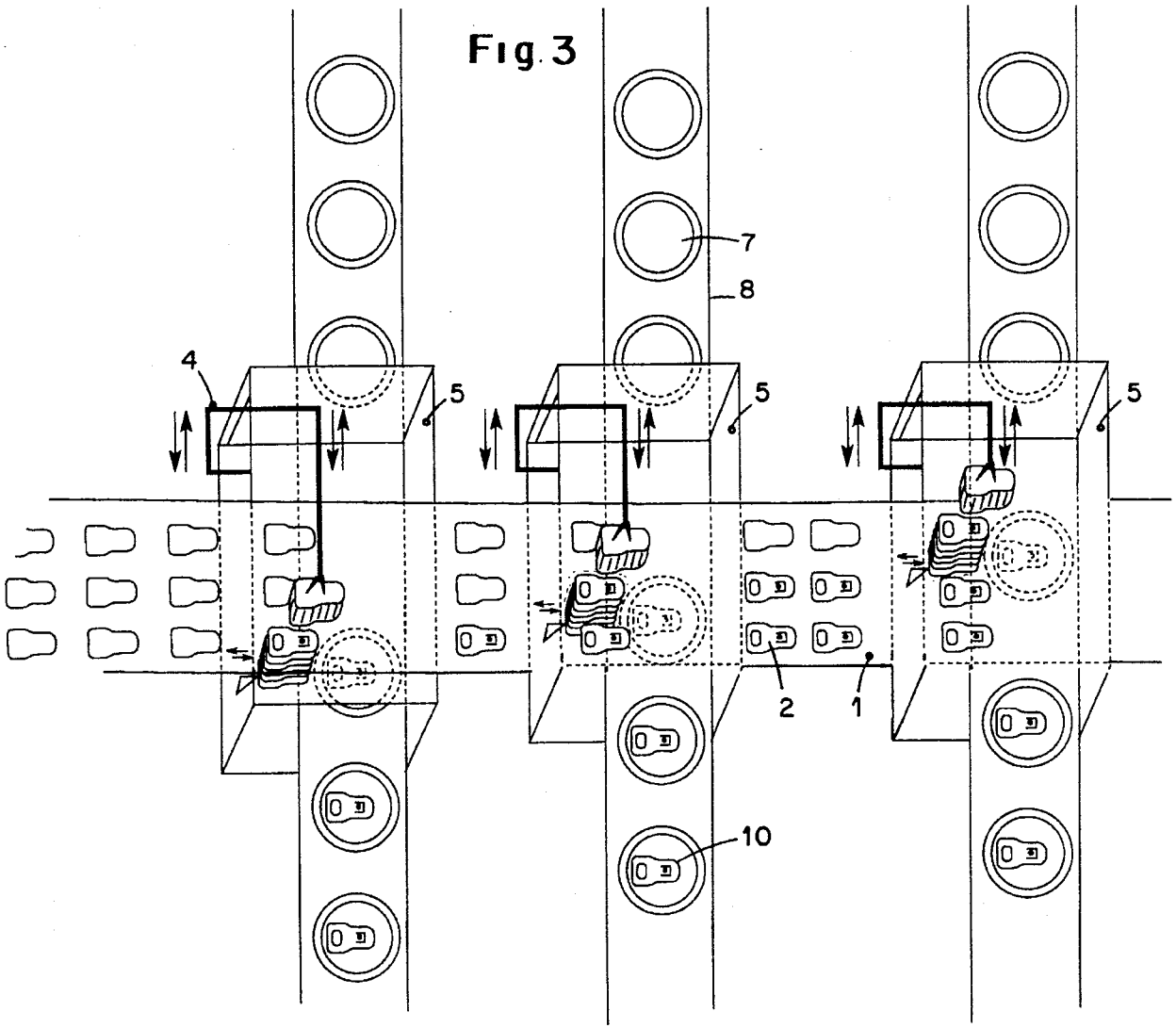
FIG. 3 is a schematic representation of the multiplicity of conversion presses with integral punches described in FIG. 1 and FIG. 2.

With reference to FIG. 3, there is shown another view of the conversion presses 5 with integral punches 4 wherein strip 1, with lift tabs 2 loosely attached, is conveyed into proper position with can tops 7 and punch 4, and the conversion presses 5 attach the separated lift tabs to can tops 7 to form completed can top assemblies 10.

The embodiments described above are merely descriptive of the principles of the invention and are not intended to limit the scope of the invention set forth in the following claims.

For further information concerning the above-described embodiments, reference may be had to Disclosure Document No. 299800, filed in the U.S. Patent Office on Feb. 11, 1992 and whose disclosure is incorporated herein by reference.

I claim:

1. A process for attaching lift tabs to can ends wherein the lift tabs are formed within a strip of flexible metal stock by a tab press so that said lift tabs are formed but remain loosely attached to said strip of metal stock and wherein the lift tabs are formed with a smooth side and an opposite roughened side, the process comprising the steps of:

conveying the flexible metal stock from the tab press so that the lift tabs exit the tab press smooth-side-down and are moved toward a conversion press with an integral punch;

inverting, during the conveying step, the metal stock through about 180 vertical degrees as it is moved toward the conversion press so that upon reaching the conversion press, the lift tabs are oriented smooth-side-up;

punching the lift tabs from the remainder of the strip;

directing the lift tabs into operative registry with the can ends; and attaching the lift tabs to the can ends; and wherein the step of directing includes a step of accumulating the punched tabs in a stacked relationship as the lift tabs are punched from the remainder of the strip and permitting the stacked tabs to be gravitationally directed toward a position adjacent the station at which the lift tabs are attached to the can ends.

2. The process as defined in claim 1 wherein the step of inverting effects a rotation of the strip of metal stock in a half-twist through about 180°.

3. The process as defined in claim 1 wherein the step of inverting effects a rotation of the strip of metal stock in a half-loop through about 180°.

4. The process as defined in claim 1 wherein the conversion press is one of a multiplicity of conversion presses including integral punch and the step of punching involves the punching of a plurality of tabs from the strip and the subsequent attachment of the lift tabs to can ends at a plurality of stations.

5. A system for forming lift-tab can end assemblies wherein each can end assembly includes a lift tab having a smooth side, an opposite roughened side and a hole extending between the sides and a can end having a protruding shaft integrally formed in one face thereof for receipt by, during an assembly-forming process, the hole in the lift tab, the system comprising:

means for advancing formed can ends in sequence through a first workstation so that as the can ends are advanced therethrough, the shafts formed therein protrude generally upwardly;

means for conveying a strip of metal stock through a second workstation and then through a third workstation wherein the third workstation is elevated above the first workstation and the second workstation is elevated above the third workstation;

first press means disposed at the second workstation for stamping pre-shaped lift-tab workpieces in the strip so that the workpieces are loosely attached to the remainder of the strip and are oriented smooth-side-down as the workpieces move from the second workstation;

the conveying means adapted to direct the strip stock which has been stamped with the pre-shaped workpieces along a path through which the strip stock is inverted so that as each pre-stamped workpiece moves into the third workstation, the workpiece is positioned smooth-side-up;

second press means disposed at the third workstation for punching the pre-shaped workpieces from the remainder of the strip as the strip is advanced through the third workstation;

means for directing the punched workpieces downwardly from the third workstation to a position disposed to one side of the first workstation;

means for moving each punched workpiece from the position disposed to one side of the first workstation to a location at which the workpiece is disposed above a can end positioned in the first workstation, the moving means being coordinated with the conveying means so that as each can end is advanced into position at the first workstation, a corresponding workpiece is moved above the can end so that the hole in the workpiece is positioned in registry with the upwardly-directed shaft formed in the can end; and third press means disposed adjacent the first workstation for deforming the shaft in a manner which joins the lift tab to the can end.

6. The system as defined in claim 5 wherein the conveying means is adapted to direct the strip stock along a path so that prior to movement of each pre-shaped workpiece into the third workstation, the strip stock is conveyed through a half-twist through about 180°.

7. The system as defined in claim 5 wherein the conveying means is adapted to direct the strip stock along a path so that prior to movement of each pre-shaped workpiece into the third workstation, the strip stock is conveyed through a half-loop through about 180°.

8. The system as defined in claim 5 wherein the directing means includes a chute through which the tabs are collected in a stacked relationship and gravitationally directed downwardly from the third workstation to the aforesaid position disposed to one side of the first workstation.

* * * * *